US005823574A

United States Patent [19]

Sullins et al.

[11] Patent Number: 5,823,574

[45] Date of Patent: Oct. 20, 1998

[54] WRITING BOARD WITH PADDED SURFACE

[75] Inventors: Patrick H. Sullins; Robert D. Sullins, both of Arlington, Tex.

[73] Assignee: Creative Manufacturing, Inc., Arlington, Tex.

[21] Appl. No.: 745,710

[22] Filed: Nov. 12, 1996

[51] Int. Cl.[6] ..... B42D 3/00

[52] U.S. Cl. ..... 281/45

[58] Field of Search ..... 281/15.1, 28, 45, 281/51

[56] References Cited

U.S. PATENT DOCUMENTS

| | | | |
|---|---|---|---|
| 2,955,972 | 10/1960 | Wintermute et al. . | |
| 4,052,944 | 10/1977 | Jennings . | |
| 5,000,327 | 3/1991 | Kincheloe | 281/45 |
| 5,090,334 | 2/1992 | Sutton . | |
| 5,222,764 | 6/1993 | Dyer | 281/45 |
| 5,297,814 | 3/1994 | Peters | 281/45 |
| 5,516,151 | 5/1996 | Mund et al. | 281/45 |

OTHER PUBLICATIONS

Heritage Products Advertisement, Book Buddy.

Levenger Tools For Serious Readers, Early Summer 1993, Readers Pillow, #AF050, p. 3.

*Primary Examiner*—Willmon Fridie, Jr.

*Attorney, Agent, or Firm*—Sidley & Austin

[57] ABSTRACT

A combination clipboard with a padded writing surface has a rigid or semi-rigid back board with a padding covering at least a portion of one surface. A netting material covers at least a portion of the padding to form a pouch for holding objects therein. The padding includes a backing sheet, a padding material positioned over the backing sheet and a covering overlying the padding material and attached at its edges to the back side of the backing sheet. This padding unit is attached to the back board. A lip is formed along the edge of the back board and the padding is positioned within the boundaries of the lip. The lip has a height which is from about 5% to about 75% of the thickness of the padding unit.

12 Claims, 4 Drawing Sheets

WRITING BOARD WITH PADDED SURFACE

TECHNICAL FIELD OF THE INVENTION

The present invention relates to a writing board, and more particularly to a portable clipboard having a padded writing surface on one side and a planar, hard surface on the opposite side, and a method for manufacturing same.

BACKGROUND OF THE INVENTION

Portable writing and book support surfaces have been available in many different forms. The traditional clipboard provides a rigid writing surface, made from various materials, and have been fitted with a grasping clip mechanism at one end for attachment of papers thereto. In some instances, these surfaces have been modified by adding various structural and textual variations to one side of the clipboard. An example of such modification is shown in the pending application, owned by the owner of the subject application, application Ser. No. 29/038,660, filed May 11, 1995, entitled "Combined Lap Pillow for Use as a Book Support" wherein a pillow-like surface is provided on one side of the writing surface to form a lap pillow. Other designs are shown in U.S. Pat. No. 5,090,334 to Sutton, U.S. Pat. No. 4,052,944 to Jennings, and U.S. Pat. No. 2,955,972 to Wintermute et al.

These products are used for the purpose of providing a writing surface and a book support and are readily portable for use in various positions and in various locations. Therefore, the products are normally subjected to extensive handling and resultant wear can often cause the added padded components to become dislocated or torn. Therefore, while these designs have been operable for their intended purpose, they have not provided for ease of manufacture and positive, secure attachment of the various modified surface materials as is necessary for the present product. Thus, a need has arisen for a readily transportable writing surface which may be adapted with a padded side wherein the padding and other variations in surface texture and components can be securely and permanently attached to the writing surface such that the product can withstand the normal use to which it is subjected.

SUMMARY OF THE INVENTION

In accordance with one embodiment of the invention, a writing board comprises a rigid or semi-rigid back board with padding covering at least a portion of one writing surface. A material covering at least a portion of said padding forms a pouch for holding objects therein. In one embodiment of the invention, the back board is substantially planar, and the material forming the pouch is attached along three of four sides to the padding.

The padding may be formed as a unit including a backing sheet with padding material positioned over the backing sheet. A covering overlies the padding material and is attached at its edges to the back side of the backing sheet opposite that on which the padding material is positioned. This padding unit, in its assembled form, is then attached to the back board.

In accordance with one embodiment of the invention, a lip is provided along at least a portion of the edge of the back board and the padding covers at least a portion of the surface of the back board on which the lip exists. The padding is positioned within the boundary formed by the lip, thereby protecting the juncture between the padding unit and the back board.

In accordance with one embodiment of the invention, the lip has a height which is from about 5% to about 75% of the thickness of the padding. In accordance with a more specific embodiment of the invention, the lip has a height which is from about 25% to about 60% of the thickness of the padding. On the opposite side of the back board from that on which the padding is attached, a protrusion is formed upwardly therefrom along a portion of one edge to form a ledge.

A hand hold or a carrying strap is attached at one end of the writing board to facilitate portability of the writing board. A clip mechanism and a pencil holder may also be attached to further facilitate use of the invention as a working surface.

BRIEF DESCRIPTION OF THE DRAWINGS

For a more complete understanding of the present invention, and for further details and advantages thereof, reference is now made to the following description taken in conjunction with the accompanying drawings, in which.

DETAILED DESCRIPTION OF THE PREFERRED EMBODIMENT

Referring now to the various figures of the drawings, there is disclosed the preferred embodiments of the present invention. In referring to the various figures, like numerals refer to like components throughout the several views.

Figure 1:
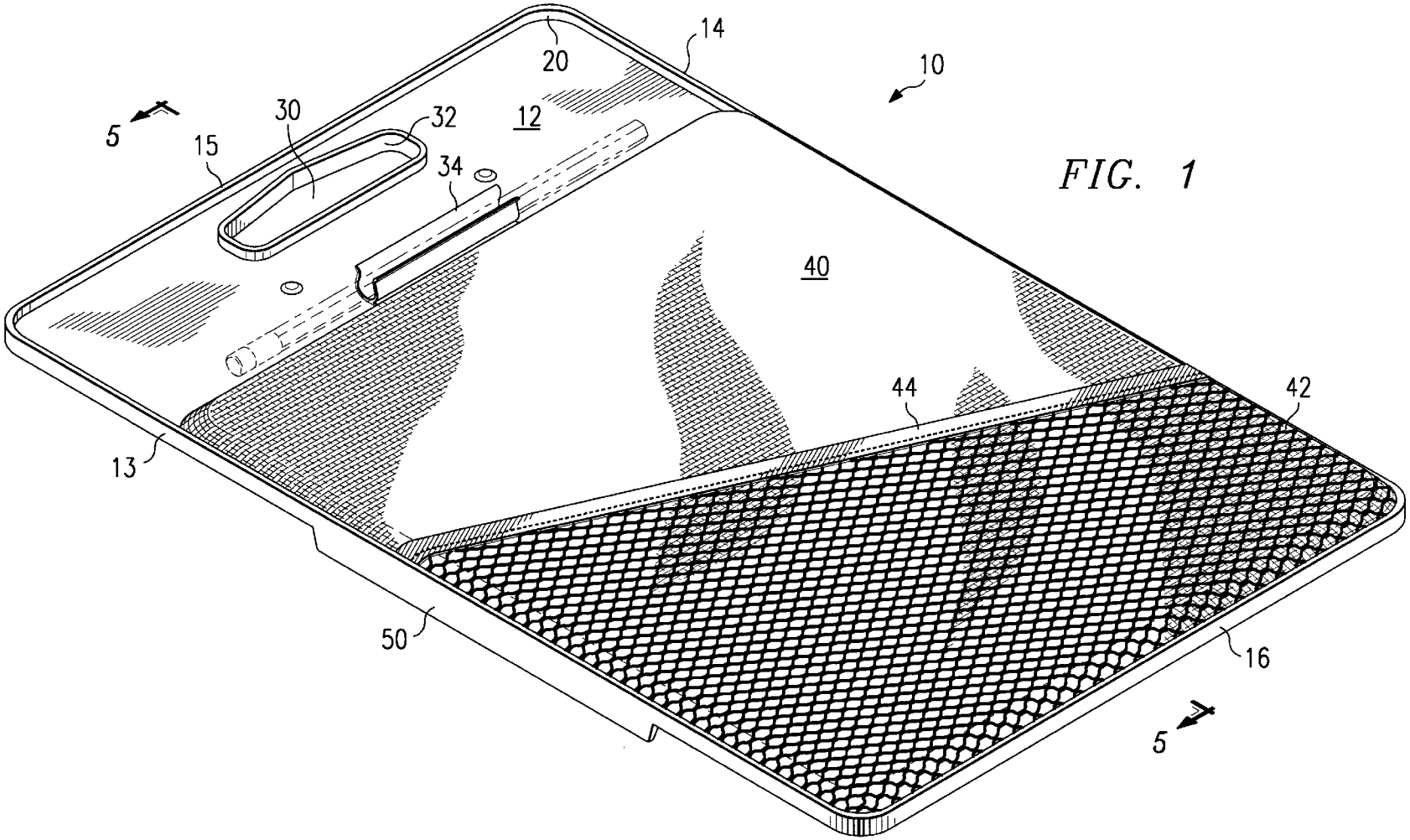
FIG. 1 is a perspective view of the writing board according to the present invention.

Referring specifically to FIG. 1, there is disclosed a writing board 10 according to the present invention. Writing board 10 is comprised of a rigid or semi-rigid back board 12, having a rectangular shape with parallel longitudinal edges 13 and 14 and parallel top and bottom edges 15 and 16.

Back board 12 may be made of various materials, including plastic, particle board, fiber board, wood or plexiglass, as well as other materials which will be well known to those skilled in the art.

Although the embodiment of FIGS. 1–5 show the use of a hand opening 30 which is formed within back board 12, it will be appreciated that a strap, or other alternative grasping means, may be attached to the back board 12 to provide a means for transporting the writing board.

A continuous lip 20 extends upwardly along the entire edge of the boundary of back board 12. Lip 20 may be formed as an integral part of back board 12 or it may be a separate piece attached thereto. While the embodiment shown, shows lip 20 positioned on the edge of back board 12, it could also be positioned inwardly from the edge as desired.

Back board 12 further has an opening 30 therethrough near the top end to provide a hand hold. This opening 30 is defined by an upstanding lip 32 encircling the boundary of the opening.

A pad unit 40 is attached to the top surface of back board 12 as shown in FIG. 1. Pad unit 40 is positioned within the boundary formed by lip 20 and extends from the lower edge 16 to a position somewhat below upper edge 15. A netting 42 is attached to pad unit 40 and partially covers the pad unit. As can be seen in FIG. 1, netting 42 is attached to pad unit 40 along three sides, namely along edge 13, 16 and 14, but is open along its upper boundary 44. In this way, netting 42 defines a pouch between the netting and the upper surface of pad unit 40. A downwardly extending protrusion 50 is formed along edge 13 of back board 12 to form a ledge on the back side of back board 12.

Figure 2:
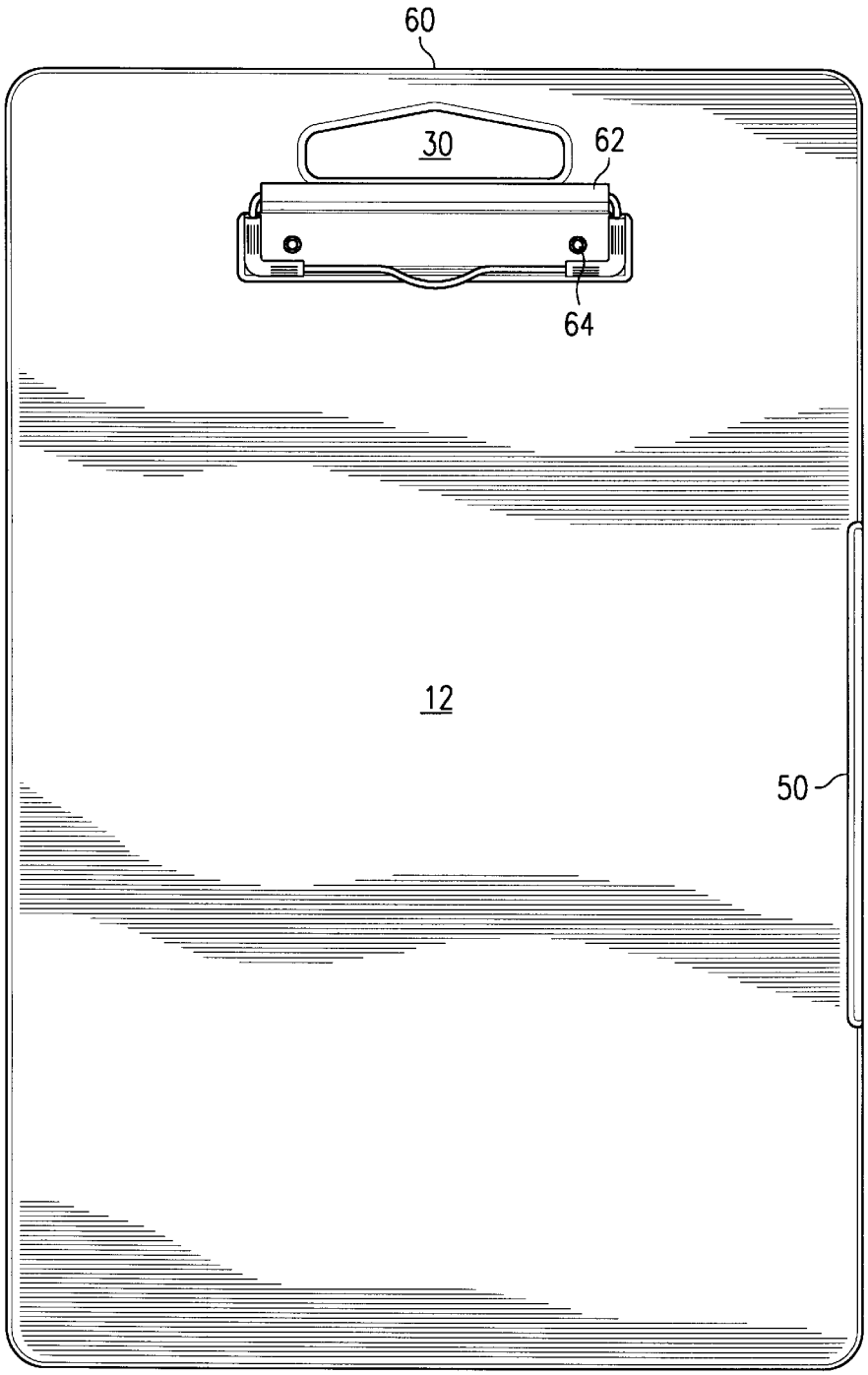
FIG. 2 is a back planar view thereof.
Figure 3:
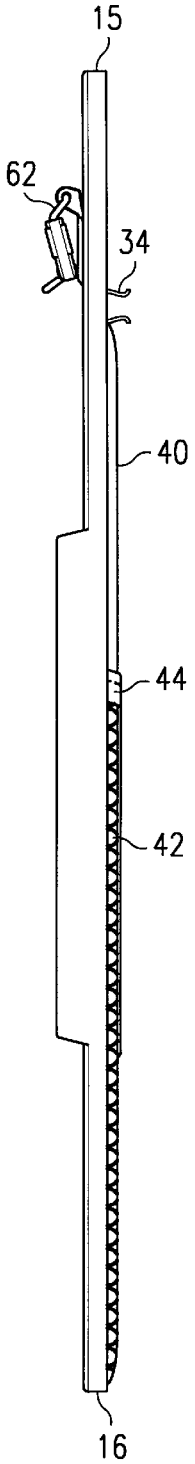
FIG. 3 is a side view thereof.

FIG. 2 more fully shows the back side of back board 12. In the preferred embodiment, the back side is smooth and planar having a chamfer 60 along its edge. A commercially available spring-loaded clip assembly 62 is attached adjacent to hand opening 30. In the preferred embodiment, this attachment is by way of rivets 64. This commercially available spring-loaded clip assembly may be obtained from various sources, one of which is Curlson Sericur Industries, Inc. Ledge 50 can be seen in FIGS. 2 and 3. FIG. 3 also shows the position of pad unit 40 in relation to upturned lip 20.

Figure 4:
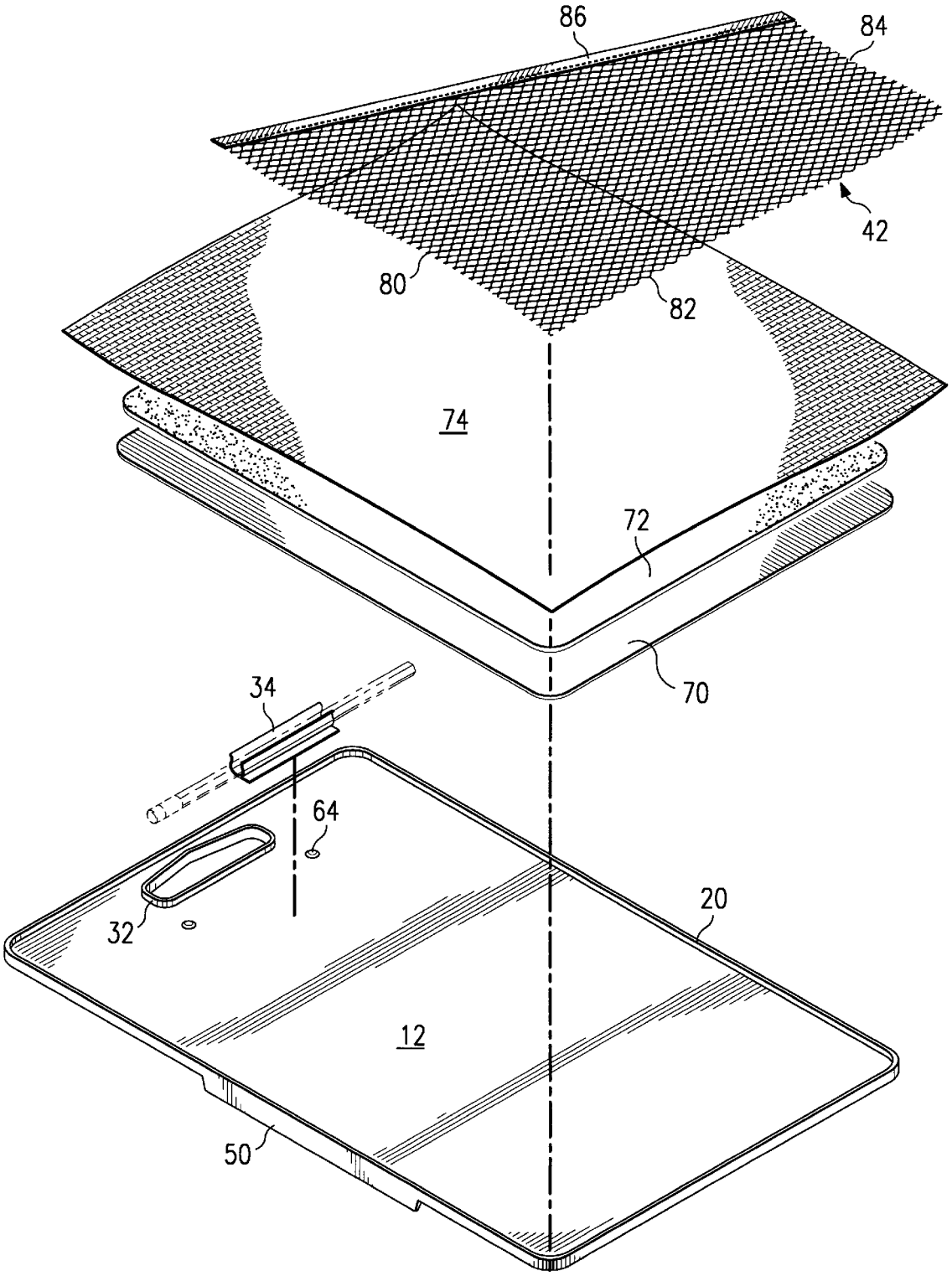
FIG. 4 is an exploded view looking from the top showing the components of the padded portion of the writing board.

FIG. 4 shows the components of writing board assembly 10 in an exploded view. Specifically, it can be seen in FIG. 4 that pad unit 40 includes a backing sheet 70 with a padding sheet of material 72 positioned thereover. An appropriate flexible covering material 74 is overlaid over padding 72 and is of a sufficient size to define a border along its edges which may be turned under sheet 70 and attached thereto by adhesive or other appropriate means. The positioning of material 74 over padding 72 and then its attachment to sheet 70 captures padding 72 therebetween. Netting 42 is then positioned over material 74 and is of a sufficient size such that edges 80, 82 and 84 may be tucked under and attached to the side of sheet 70 opposite padding 72. Netting 42 has an exposed edge which is covered by piping 86. This edge of netting 42 is left unattached such that a pocket is formed between netting 42 and pad unit 40. FIG. 4 also shows the pencil holder 34 in a removed position from its attachment to back board 12, such attachment being made by use of an adhesive or other appropriate means.

Figure 5:
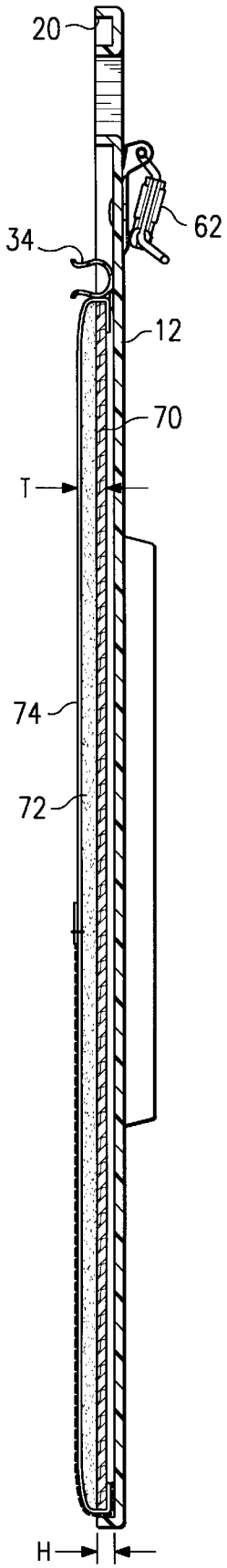
FIG. 5 is a section view taken along line 5—5 of FIG. 1.

FIG. 5 shows a section view of writing board 10 taken along line 5—5 of FIG. 1. In this section view, the relationship of pad unit 40 and its components, namely sheet 70, padding 72 and covering 74, and their relationship to lip 20, can be seen. Specifically, pad unit 40 is attached within the boundary of lip 20 by attachment of the back side of sheet 70 and the edge border of material 74 and netting 42 attached to sheet 70, to the upper surface of back board 12. In a preferred embodiment, adhesive is used to make this attachment. When attached, the in-turned edges of covering material 74 and the in-turned edges of netting 42 are captured between sheet 70 and back board 12. In accordance with an important aspect of the present invention, lip 20 also provides additional surface area on which padding unit 40 may be attached to back board 12. Lip 20 also provides a restraint against the movement of pad unit off of back board 12. Additionally, lip 20 covers and provides protection to the juncture between pad unit 40 and back board 12.

Because the present invention is readily transportable, and is intended to be so, it is subjected to significant wear and, in some cases, abuse which places significant stresses on the juncture between pad unit 40 and back board 12. In prior art units, there has also been the tendency for a covering to be pried off of the base board. In the event that pad unit 40 were to become separated, even in part, from back board 12, then the product would, for most practical purposes, become useless. The likelihood of padding unit 12 being pulled away from back board 12 is significantly reduced by providing lip 20 which is adjacent to and covers the juncture between pad unit 40 and back board 12 in its position, lip 20 significantly reducing the likelihood that padding unit 40 will be pulled away or pried from back board 12. Additionally, lip 20 provides a finished look to the product without requiring an excessive amount of care and attention to the assembly of pad unit 40 and its attachment to back board 12. Thus, the incorporation of lip 20 greatly facilitates the manufacture of the present product with minimum labor costs.

In a preferred embodiment, the height H of lip 20 is from about 5% to about 75% of the thickness T of pad unit 40. Designing the lip height within this range provides for sufficient protection to the juncture between pad unit 40 and back board 12 while permitting the upper surface of pad unit 40, defined by covering 74, to be above lip 20. To conserve material, and to provide slightly more exposure to the padded surface of pad unit 40, the height of lip 20, in yet another preferred embodiment, is between about 25% and about 50% of the thickness T of pad unit 40.

FIGS. 2, 3 and 5 also reveal the back side of writing board 12 which takes on the more traditional clipboard arrangement, providing a rigid or semi-rigid writing surface with a ledge 50 for supporting books and other materials.

Although preferred embodiments of the invention have been described in the foregoing description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

What is claimed is:

1. A writing board comprising:

a back board having front and back surfaces;

a padding unit covering at least a portion of one surface of said back board, said padding unit including a backing sheet, and padding material positioned over the backing sheet with said backing sheet being attached to said board; and a flexible material covering at least a portion of said padding unit to form a pouch for holding objects therein.

2. A writing board comprising:

a back board having front and back surfaces;

a padding unit covering at least a portion of one surface of said back board, said padding unit including a backing sheet, padding material positioned over the backing sheet, and a covering overlying the padding material and attached at its edges to the side of said backing sheet opposite that on which the padding material is positioned; and a flexible material covering at least a portion of said padding to form a pouch for holding objects therein.

3. A writing board comprising:

a back board having front and back surfaces;

a lip on said back board to define a boundary padding covering at least a portion of one surface on said back board and positioned within the boundary defined by said lip; and a flexible material covering at least a portion of said padding to form a pouch for holding objects therein.

4. The writing board of claim 3 wherein said lip has a height which is from about 5% to about 75% of the thickness of said padding.

5. The writing board of claim 3 wherein said lip has a height which is from about 25% to about 60% of the thickness of said padding.

6. The writing board of claim 5 wherein the surface of said back board opposite said padding has a ledge extending upward therefrom along a portion of one edge of said back board.

7. A writing board comprising:

a back board;

a lip on said back board to define a boundary thereon; and padding covering at least a portion of one surface on said back board and positioned within the boundary of said lip;

wherein said padding includes a padding unit comprising a backing sheet and padding material positioned over the backing sheet.

8. The writing board of claim 7 further comprising:

a flexible material overlying only a portion of said padding and attached to said padding to form a pouch between the flexible material of said padding.

9. A writing board comprising:

a back board;

a lip on said back board to define a boundary thereon; and padding covering at least a portion of one surface on said back board and positioned within the boundary of said lip;

wherein said padding includes a padding unit comprising a backing sheet, padding material positioned over the backing sheet, and a covering overlying the padding material and attached at its edges to the side of said backing sheet opposite that on which the padding material is positioned.

10. The writing board of claim 9 further comprising:

a flexible material overlying only a portion of said covering and attached to the padding unit to form a pouch between said flexible material and said padding covering.

11. The writing board of claim 9 further comprising:

a netting material overlying only a portion of said covering and attached to the padding unit to form a pouch between the netting material and the padding covering.

12. The writing board of claim 11 wherein said netting material has four edges and is attached on three of four edges to the padding unit.

* * * * *